US009238897B2

(12) United States Patent
Nolan et al.

(10) Patent No.: US 9,238,897 B2
(45) **Date of Patent: *Jan. 19, 2016**

(54) UNIVERSAL SKIRT BOARD

(71) Applicant: CPG International LLC, Scranton, PA (US)

(72) Inventors: Patrick Nolan, Royersford, PA (US); Michael A. Dotsey, Pottstown, PA (US)

(73) Assignee: CPG International LLC, Scranton, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/052,142

(22) Filed: Oct. 11, 2013

(65) Prior Publication Data

US 2014/0033622 A1 Feb. 6, 2014

Related U.S. Application Data

(62) Division of application No. 12/985,650, filed on Jan. 6, 2011, now Pat. No. 8,578,660.

(51) Int. Cl.

| | |
|---|---|
| ***E04F 19/02*** | (2006.01) |
| ***E04F 19/04*** | (2006.01) |
| ***E02D 31/02*** | (2006.01) |
| ***E04B 1/64*** | (2006.01) |

(52) U.S. Cl.

CPC . *E02D 31/02* (2013.01); *E04B 1/64* (2013.01); *E04F 19/02* (2013.01); *E04F 19/04* (2013.01); *E04F 19/045* (2013.01); *E04F 19/0468* (2013.01); *E04F 2019/0422* (2013.01); *E04F 2019/0427* (2013.01)

(58) Field of Classification Search

CPC ..... E04D 13/15; E04D 13/158; E04F 19/02; E04F 19/04; E04F 2019/0422; E04F 19/045; E06B 2001/628

USPC ..... 52/58, 60, 61, 62, DIG. 3, 302.6, 287.1, 52/288.1, 97, 520, 551, 716.1, 716.8, 52/718.01, 717.05

See application file for complete search history.

(56) References Cited

U.S. PATENT DOCUMENTS

| | | | | | |
|---|---|---|---|---|---|
| 3,120,082 | A | | 2/1964 | Mendelsohn | |
| 3,899,859 | A | * | 8/1975 | Smith | E04F 19/0468 52/288.1 |
| 4,343,126 | A | | 8/1982 | Hoofe, III | |
| 4,485,600 | A | * | 12/1984 | Olson | E04F 13/10 52/396.07 |
| 5,349,802 | A | | 9/1994 | Kariniemi | |
| 5,553,419 | A | * | 9/1996 | Jenkins, II | 49/469 |
| 5,564,245 | A | * | 10/1996 | Rademacher | E04F 13/0864 52/520 |
| 5,884,435 | A | | 3/1999 | David et al. | |
| 5,918,427 | A | * | 7/1999 | VanderWerf | A01M 1/24 52/100 |
| 5,937,600 | A | * | 8/1999 | Larson | E04B 1/762 52/302.6 |
| 5,987,838 | A | | 11/1999 | Beck | |

(Continued)

*Primary Examiner* — Ryan Kwiecinski

(74) *Attorney, Agent, or Firm* — Buchanan Ingersoll & Rooney PC

(57) ABSTRACT

A universal skirt board has a base, a top flange section, an overhang section, and a sealing flange attached to the top flange section. The base has at least one ridge extending away from the base in a first direction, and a projection extending in the first direction. The top flange section is attached to the base. The overhang section is also attached to the base and defines a drip edge. The sealing flange is attached to the top flange section. The at least one ridge is formed to rest on a top of a base board. The projection is formed to fit into a slot defined in the top of the base board to provide an interference connection.

12 Claims, 11 Drawing Sheets

(56) References Cited

U.S. PATENT DOCUMENTS 6,122,877 A 9/2000 Hendrickson
6,293,064 B1 * 9/2001 Larson ..... E04B 1/762 52/209
6,293,072 B1 * 9/2001 Hodgson ..... E04F 19/02 52/716.1
6,298,609 B1 * 10/2001 Bifano ..... E04B 1/765 52/101
6,682,814 B2 1/2004 Hendrickson
7,284,353 B2 * 10/2007 Bealko ..... E04C 3/28 52/656.5
7,406,805 B1 * 8/2008 Larson ..... E04F 13/06 52/364
7,621,079 B2 * 11/2009 Takagi ..... E04B 1/70 52/100
7,634,883 B1 * 12/2009 Larson et al. ..... 52/573.1
7,654,046 B2 * 2/2010 Ellingson ..... E04G 21/30 52/212
7,833,613 B1 * 11/2010 Rometti ..... E04F 13/0803 428/192
8,347,567 B2 * 1/2013 Nolan ..... E06B 1/62 49/504
2002/0029537 A1 3/2002 Manning
2002/0092256 A1 7/2002 Hendrickson
2004/0093806 A1 * 5/2004 Mares ..... E04D 13/1478 52/62
2005/0204657 A1 9/2005 Ellingson
2007/0062137 A1 * 3/2007 Maylon ..... E04F 13/06 52/367
2007/0157528 A1 * 7/2007 Gawoski ..... E04D 13/1415 52/58
2007/0212970 A1 9/2007 Rockwell
2008/0104918 A1 * 5/2008 Gleeson ..... E04B 1/74 52/489.1
2008/0178557 A1 * 7/2008 Parsons et al. ..... 52/741.1
2009/0183453 A1 * 7/2009 Koessler ..... E04F 13/007 52/302.3
2010/0132295 A1 * 6/2010 Bootier ..... E04F 13/18 52/520
2010/0212234 A1 * 8/2010 Monteer ..... E04D 13/152 52/95

* cited by examiner

UNIVERSAL SKIRT BOARD

CROSS-REFERENCE TO RELATED APPLICATIONS

This application is a divisional application claiming priority to pending U.S. patent application Ser. No. 12/985,650, which was filed on Jan. 6, 2011, and incorporated by reference herein.

BACKGROUND OF THE INVENTION

1. Field of the Invention

The present invention relates to improvements in siding components and siding assemblies.

2. Description of the Related Art

Water intrusion around foundations of structures is highly problematic for builders and building owners. Damage resulting from water intrusion can be costly to repair. Skirt boards are commonly used and required by many building codes to transition between the foundation and the framed exterior of a structure in order to avoid water intrusion around a foundation. Skirt boards are designed to help shed water away from the foundation and also include a starter strip that helps protrude the first row of siding at an outward angle from the structure. The angle of the siding is designed to channel water down and away from the house and foundation.

Siding is made in various types and from many different materials. Thin sheet vinyl siding is most common, although solid siding of different dimensional thicknesses is popular and can include wood siding cedar shakes, or fiber cement board. Skirt boards are used in conjunction with all of these types of siding materials to support the first course of siding and to provide the appropriate kick out angle on the first course of siding. The skirt board and siding must be configured and installed in a manner so that water or moisture does not enter past the seam where the skirt board and the siding meet.

The installation of these components is typically done by contractors who are experienced in building construction. But many home and building owners desire to install siding on their own. Consequently, there is a need for a skirt board suitable for use with all types of siding that is easy to install and designed to reduce the cost associated with installing a skirt board around the foundation of a house or other structure. Such a product may mitigate the confusion and possibility of missing a critical step in the construction process. Thus, there is also a need for a skirt board system that is easy to manufacture, and allows for diverting water from around the foundation of a structure and from within and around the seams of siding placed on the outside of the structure.

SUMMARY OF THE INVENTION

A universal skirt board is disclosed herein that has a base, a top flange section, an overhang section, and a sealing flange that is attached to the top flange section. The base has at least one ridge extending away from the base in a first direction, and a projection extending in the first direction. The top flange section is positionable adjacent to the base. The overhang section is positionable adjacent to the base and defines a drip edge. The at least one ridge is sized and configured on the base to rest on a top of a base board. The projection is sized and configured to fit into a slot defined in the top of the base board.

In another preferred embodiment the universal skirt board further comprises a base board having a top, a bottom, a front, and a back. The top has a middle and a slot defined in the middle. The at least one ridge rests on the top of the base board. The projection is located in the slot in the top of the base board and provides an interference connection.

In another preferred embodiment, the universal skirt board comprises a base board and a universal skirt that can be integrally connected. The base board has a top, a bottom, a front, and a back. The universal skirt has a base, a top flange section, an overhang section, and a sealing flange attached to the top flange section. The base has a top and a bottom. The top flange section is attached to the base. The overhang section is also attached to the base. The bottom of the base is attached to the top of the base board.

In another preferred embodiment the projection has at least one protrusion. The at least one protrusion of the projection is sized and configured to engage a slot in the top of a base board.

In another preferred embodiment the base, the top flange section, the overhang section, and the sealing flange are formed such that the base, the top flange section, the overhang section, and the sealing flange can be integrally connected. The components of the universal skirt board can be formed integrally through molding or extrusion.

In another preferred embodiment the universal skirt board is a plastic extrusion.

In another preferred embodiment the sealing flange comprises a gasket and a lower edge. The lower edge is located between the gasket and the top flange section.

In another preferred embodiment the gasket of the sealing flange is made from soft vinyl and the top flange section is made from rigid vinyl.

In another preferred embodiment the top flange section has a structure to allow the top flange section to be fastened to a surface. The structure is plurality of apertures or an adhesive.

In another preferred embodiment the top flange section has peel and stick tape attached to seal the top flange section to a surface.

In another preferred embodiment the universal skirt board is located adjacent to a foundation of a building.

The universal skirt board may have a dimensional thickness similar to wood skirt boards, but can incorporate a co-extruded strip of thin gauge polyvinyl chloride ("PVC") as a mating flange for accepting many different types of siding, including thin sheet PVC siding or solid surface siding made from such materials as wood, cellular PVC, and fiber cement board. The sealing flange may have a lower edge geometry which engages and snap locks to standard thin sheet vinyl siding locking geometries. The universal skirt board may also be engineered to have an upward and curved overhang so any water that penetrates the seam is channeled back down and away from the structure. The geometry of the sealing flange also may have engineered "hinges" that allow the geometry to compress when used in conjunction with solid surface siding. This is so the siding and the sealing flange form a tight compression fit, while also compressing close to a building so the first course of solid material siding is not angled too greatly away from the building.

The universal skirt board is a universal solution for builders who use skirt boards with many different types of siding including sheet siding, siding shingles, or solid siding, along with various thicknesses or materials of siding. Types of siding that the universal skirt board will easily mate with include wood siding, aluminum siding, vinyl siding, hardboard composite, fiberglass, and cement fiber siding. Therefore, the universal skirt board allows for one product to be used with nearly any variety of siding styles, materials, or thicknesses. It also provides a superior water repelling barrier between the meeting of the skirt board and the first course of siding.

Other details, objects, and advantages of the invention will become apparent as the following description of certain present preferred embodiments thereof proceeds.

BRIEF DESCRIPTION OF THE FIGURES

In the accompanying drawings we have shown certain present preferred embodiments of our water barrier trim in which.

DESCRIPTION OF THE PREFERRED EMBODIMENTS

Figure 1:
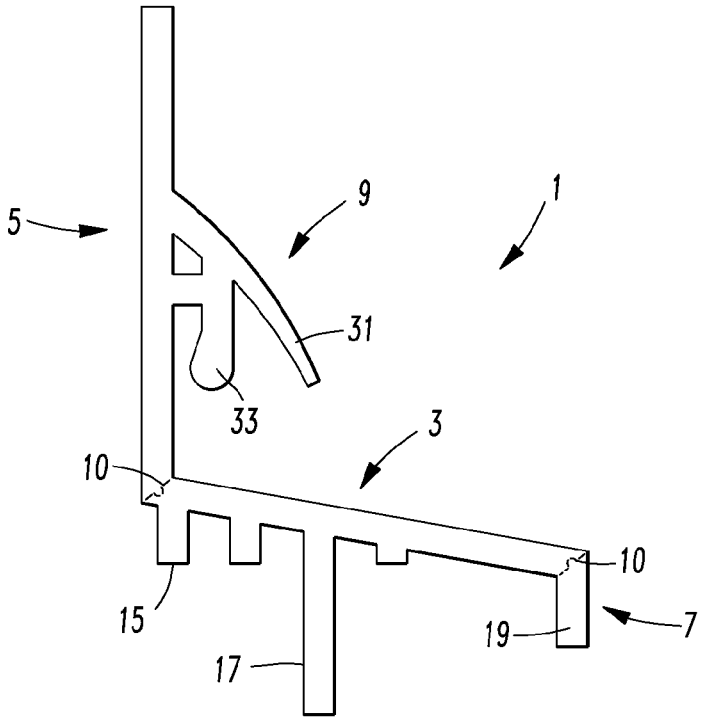
FIG. 1 is an end view of a present preferred embodiment of our universal skirt board.

Referring to FIG. 1 a universal skirt board 1 comprises a base 3, a top flange section 5, an overhang section 7, and a sealing flange 9 attached to the top flange section 5. The sealing flange 9 may be configured as shown, where the sealing flange 9 includes a gasket 31 and a lower edge 33 located between the gasket 31 and the top flange section 5. The base 3 has at least one ridge 15 extending away from the base 3 in a first direction, and a projection 17 extending in the first direction. The top flange section 5 is positionable adjacent to the base 3. The overhang section 7 is positionable adjacent to the base 3 and defines a drip edge 19. The at least one ridge 15 is formed to rest on the top of a base board. The projection 17 is formed to fit into a slot defined in the top of the base board to provide an interference connection.

In addition, the gasket 31 of the sealing flange 9 may be manufactured from soft vinyl and the top flange section 5 may be made from rigid vinyl. The gasket may be formed of a softer durometer as well, such as 70 shore A.

Figure 1A:
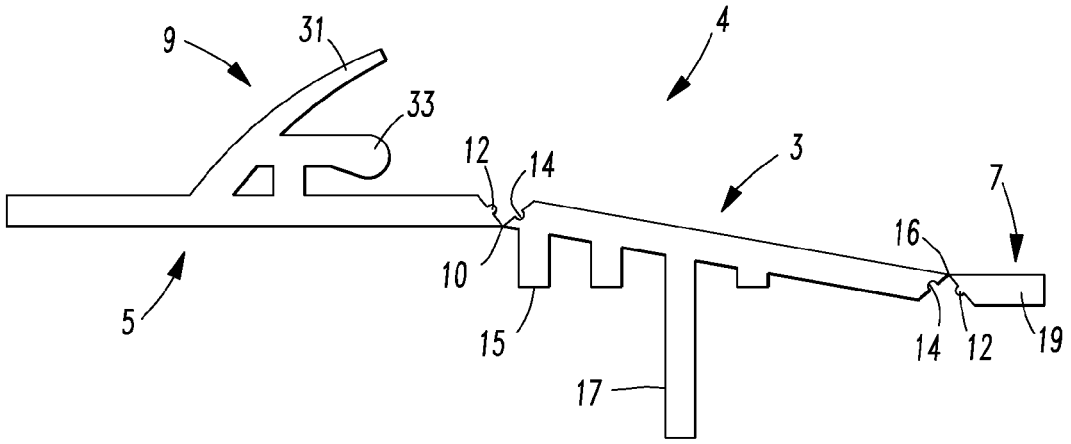
FIG. 1*a* is an end view of a second preferred embodiment of our universal skirt board.

FIG. 1*a* shows a second preferred embodiment of the present invention, similar to the embodiment of FIG. 1, in which the universal skirt board 4 further includes a first hinge structure 10 and an interlocking tongue 12 and groove 14 and a second hinge structure 10 and an interlocking tongue 12 and groove 14. The hinge structure 10 and the tongue 12 and groove 14 allow the universal skirt board 4 to be packaged more compactly. The hinge structure 10 and the tongue 12 and groove 14 allow the universal skirt board 4 to be more easily rolled and unrolled when it is manufactured as a plastic extrusion or molded piece.

The geometry of the universal skirt board is engineered to produce a tight interference fit between the universal skirt board and a base board to prevent water from penetrating through. Those skilled in the art will recognize that geometries other than those shown in the drawings may be used for the universal skirt board. For example, the projection 17 may be formed in an ovular shape such that the projection compresses as it is inserted into the slot of a base board or the projection may have an inverted T-shape.

Figure 2:
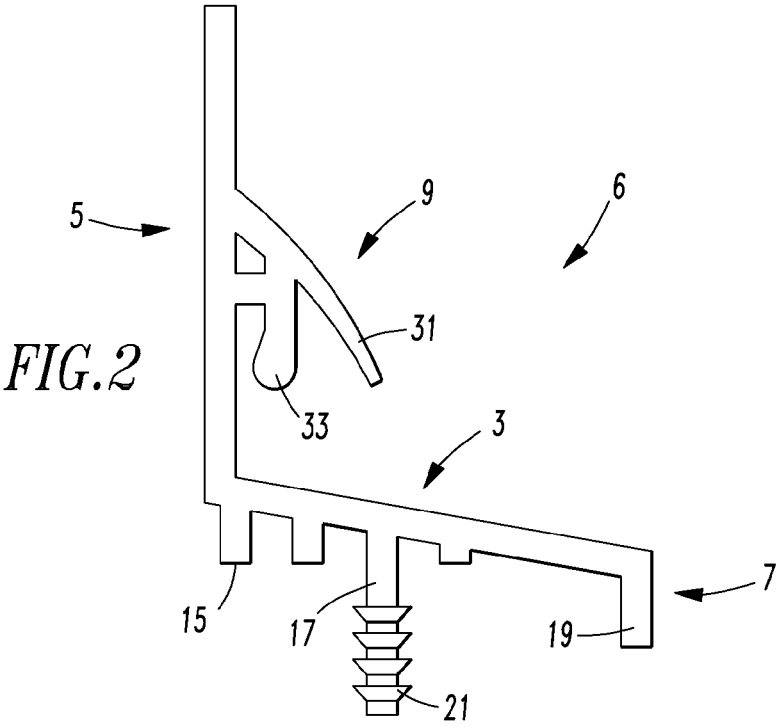
FIG. 2 is an end view of another preferred embodiment of our universal skirt board.

FIG. 2 shows another preferred embodiment of the present invention, similar to the embodiment of FIG. 1, in which the projection 17 includes at least one protrusion 21. The at least one protrusion 21 of the projection 17 is sized and configured to engage a slot of a trim board. Further, the at least one protrusion 21 is sized and configured so that the amount of force necessary to remove the universal skirt board 1 from a base board is much greater than the amount of force required to install the universal skirt board 1 to the base board.

Figure 4:
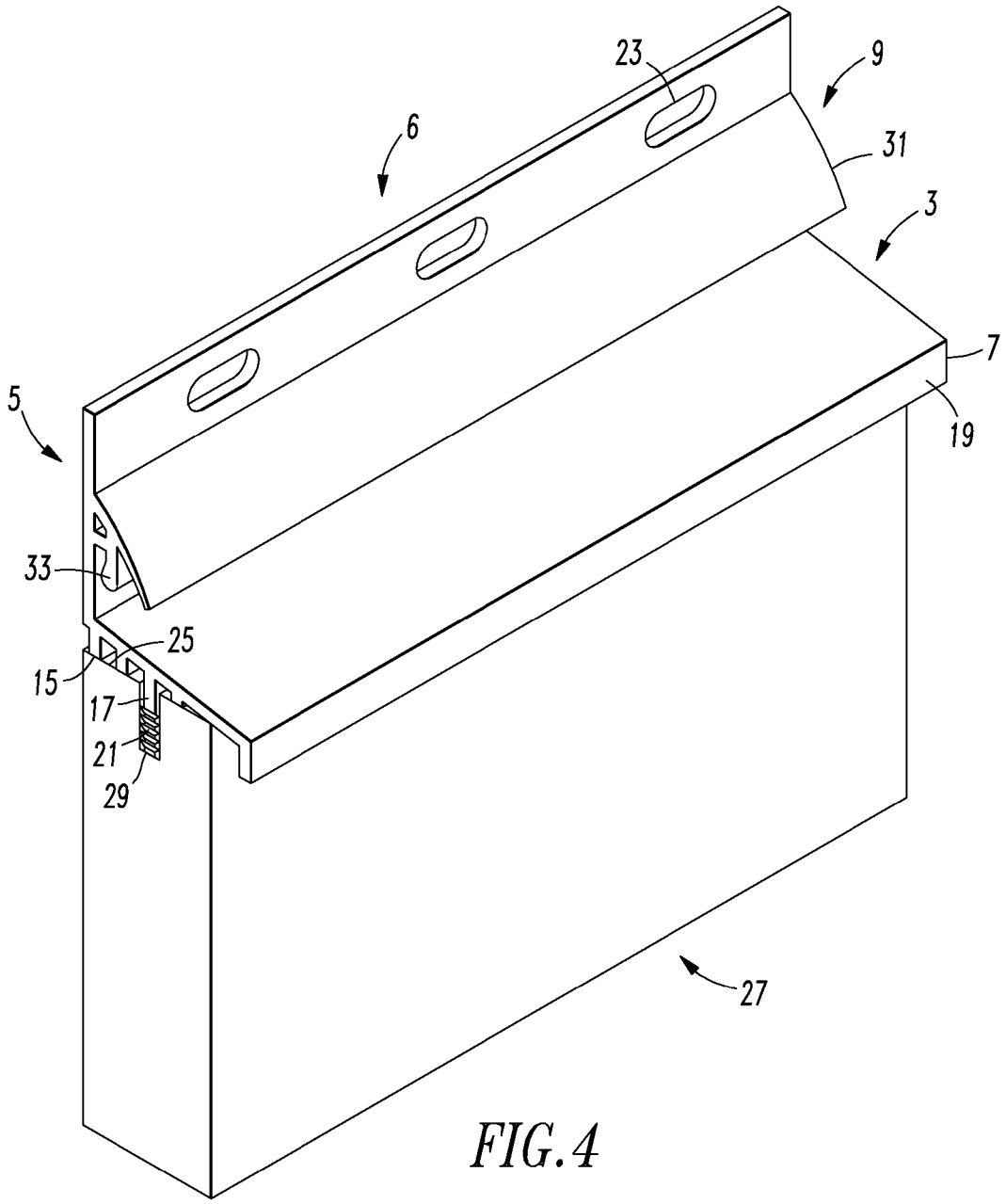
FIG. 4 is a front perspective view of the embodiment shown in FIG. 2 engaged with a base board.

The top flange section 5 may have a plurality of apertures 23, as shown in FIG. 4, to allow the top flange section 5 to be fastened to a surface. An adhesive, such as cyanoacrylate, or plastic cement may also be included to allow the top flange section 5 to be fastened to a surface.

Figure 3:
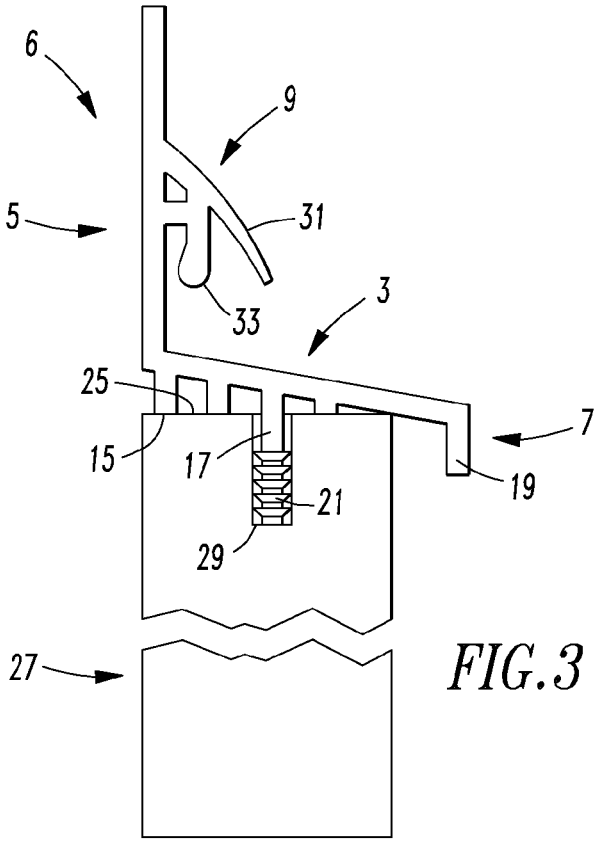
FIG. 3 is an end view of the preferred embodiment shown in FIG. 2 engaged with a base board.

FIGS. 3-4 show the universal skirt board 6 of FIG. 2 engaged with a base board 27. The at least one ridge 15 rests on the top 25 of the base board 27 providing an inclined or sloping surface to repel water downward. The projection 17 is formed to fit into a slot 29 defined in the top 25 of the base board 27 to provide an interference connection that prevents movement of the universal skirt board when it is engaged with the base board 27. Further, the at least one protrusion 21 of the projection 17 is formed to engage the slot 29 to provide a fixed connection.

The slot should be sized and configured in the middle of the top of the base board to allow the universal skirt board to be used with either the front or back surface of the base board made visible. Having a slot sized and configured in the middle of the top of the base board allows for a different surface finish to be employed on either the front or back surface of a base board. A user is then able to choose which surface is visible after installation.

Figure 5:
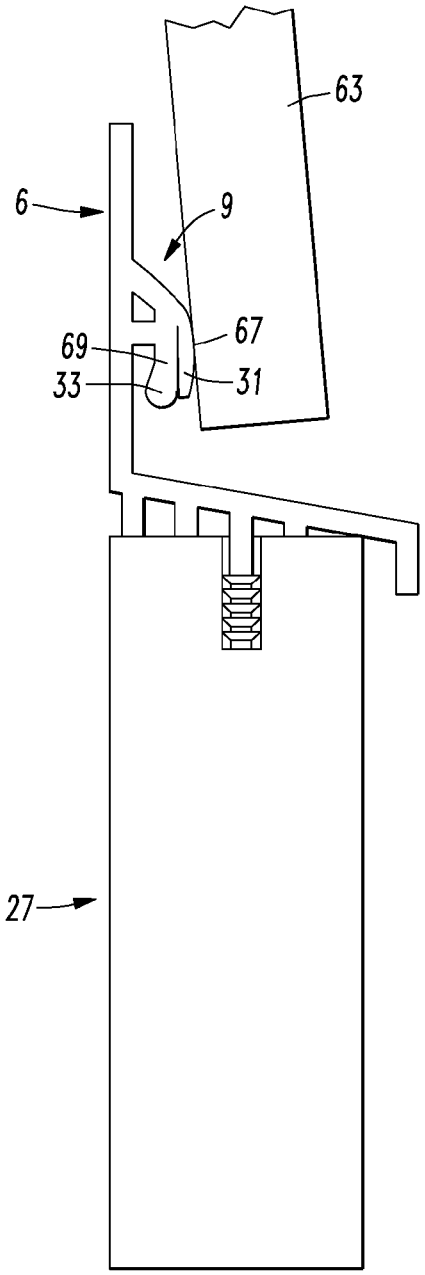
FIG. 5 is an end view of the embodiment shown in FIG. 2 engaged with a base board and used in conjunction with solid siding.

FIG. 5 shows the universal skirt board 6 of FIG. 2 engaged with a base board 27 and used in conjunction with solid siding 63. The gasket 31 provides a mating surface that forms a seal 67 when the universal skirt board 6 is used with solid siding 63. The lower edge 33 provides a support structure 69 for the gasket 31 so that the gasket 31 forms a tight seal 67 when the gasket 31 is compressed by the solid siding 63. The seal 67 and the U-shape of the lower edge 33 prevent water from entering between the solid siding 63 and the sealing flange 9.

Figure 6:
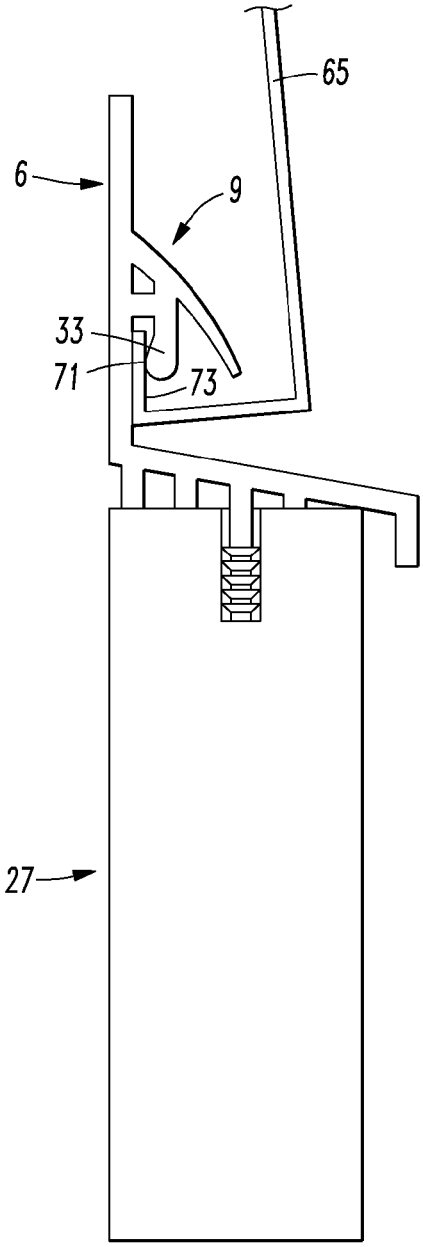
FIG. 6 is an end view of the embodiment shown in FIG. 2 engaged with a base board and used in conjunction with sheet siding.

FIG. 6 shows the universal skirt board 6 of FIG. 2 engaged with a base board 27 and used in conjunction with sheet siding 65. The lower edge 33 provides a connecting structure 71 to engage the edge 73 of sheet siding 65 in order to lock the sheet siding 65 in place with relation to the universal skirt board 6. Further, the U-shape of the lower edge 33 prevents water from entering between the sheet siding 65 and the sealing flange 9.

The universal skirt board may be manufactured with the base 3, the top flange section 5, the overhang section 7, and the sealing flange 9 such that the base 3, the top flange section 5, the overhang section 7, and the sealing flange 9 are formed as a single integral structure or are each a separate entity. The base 3, the top flange section 5, the overhang section 7, and the sealing flange 9 can be formed integrally or separately through routing, molding, extrusion, or any other preferred manufacturing technique. Of course, the universal skirt board may be manufactured as a plastic extrusion or molded in standard lengths which can be rolled and unrolled. Further, the universal skirt board and its components can be manufactured from any of a number of plastics, polymer materials, or other suitable materials, for example PVC, polypropylene, or polycarbonate.

Figure 7:
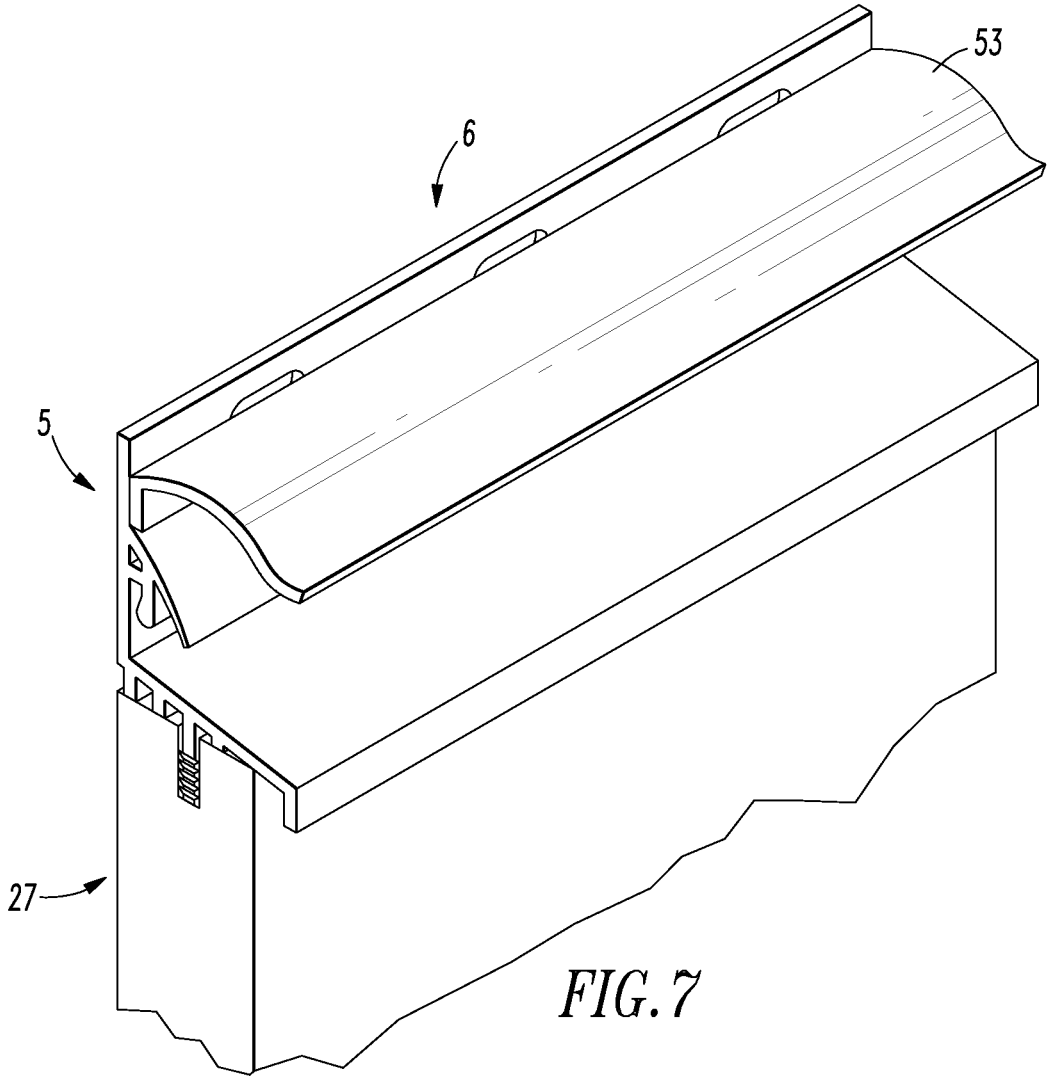
FIG. 7 is a front perspective view of the embodiment shown in FIG. 2 engaged with a base board and the top section having peel and stick tape attached.
Figure 8:
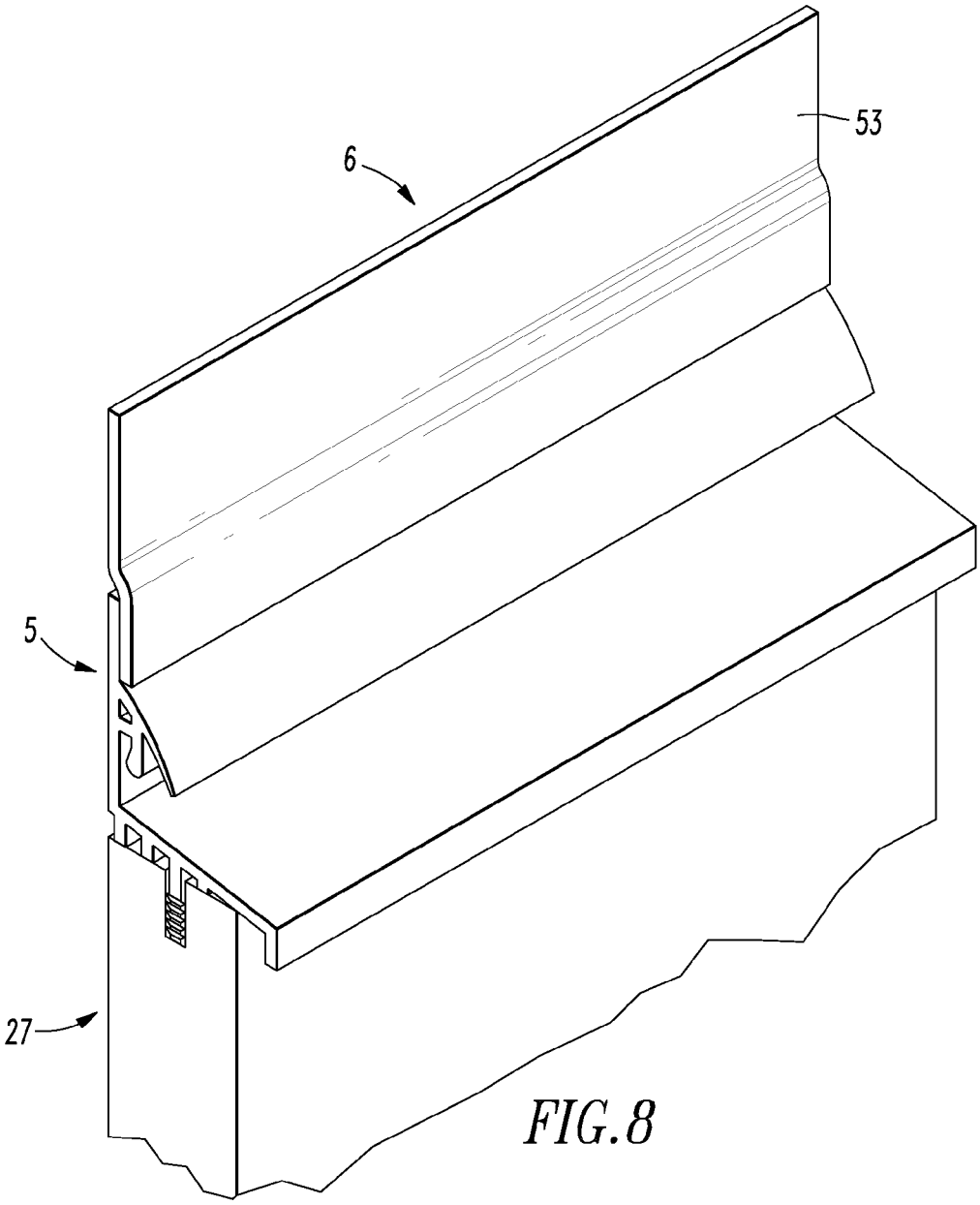
FIG. 8 is a front perspective view of the embodiment shown in FIG. 2 engaged with a base board and the top section having peel and stick tape attached and forming a seal with a surface.

FIGS. 7-8 show another preferred embodiment of our universal skirt board 6 engaged with a base board 27 and the top flange section 5 has peel and stick tape 53 attached. The peel and stick tape 53 allows for the top flange section 5 to be sealed to a surface. The seal that is formed acts as a further barrier to prevent water from entering between the top flange section 5 and the exterior of a house or building to which the universal skirt board is attached.

Figure 9:
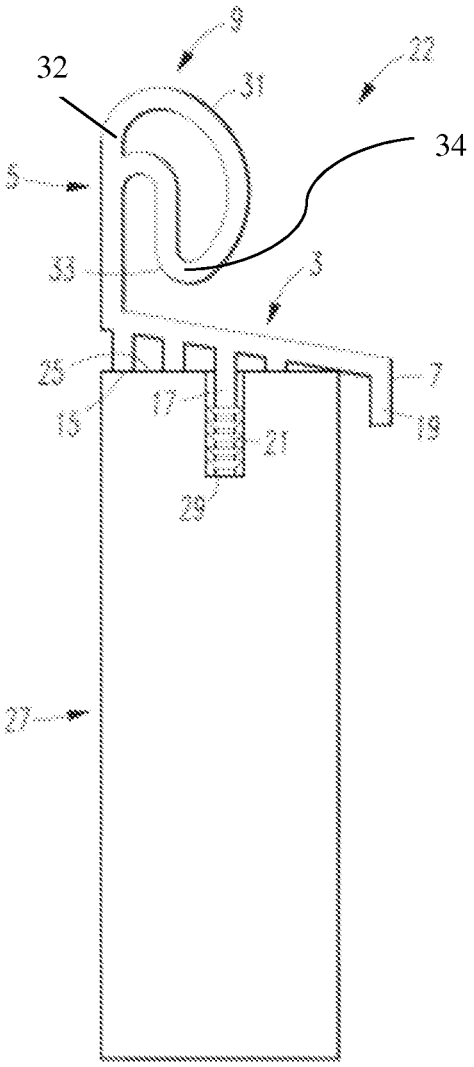
FIG. 9 is an end view similar to FIG. 3 of another preferred embodiment of our universal skirt board engaged with a base board.
Figure 10:
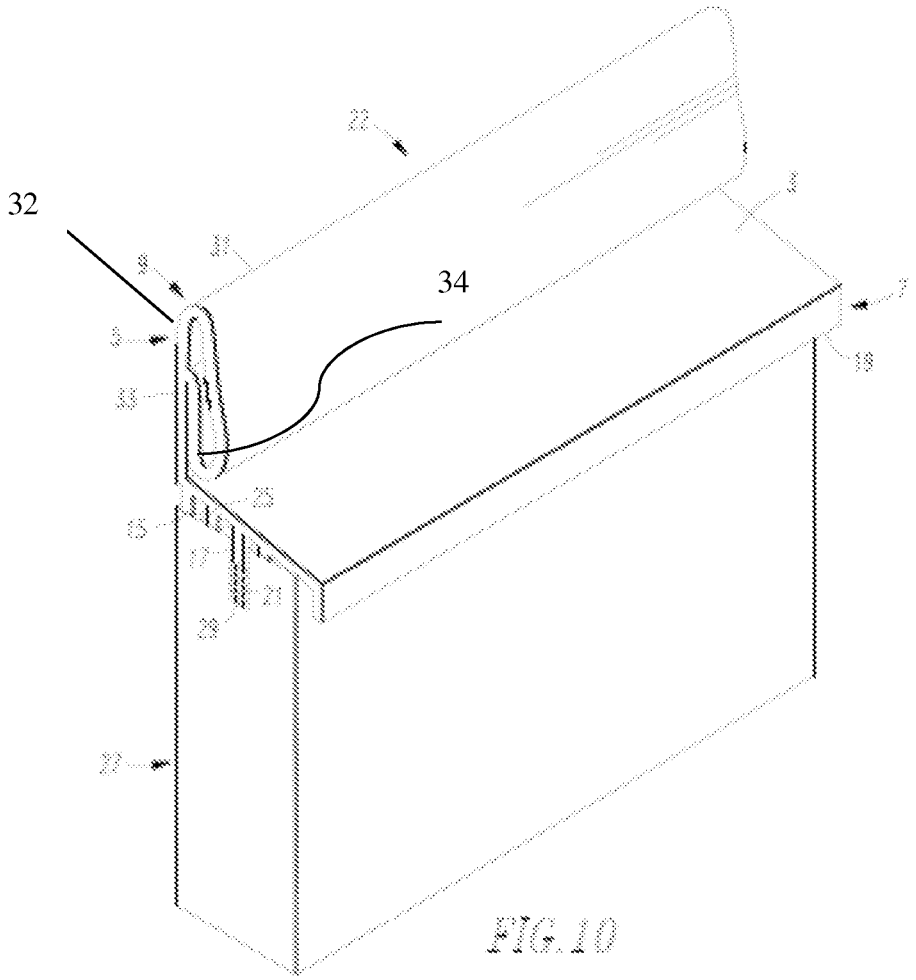
FIG. 10 is a front perspective view of the embodiment shown in FIG. 9 engaged with a base board.

FIGS. 9-10 show another preferred embodiment of our universal skirt board 22 engaged with a base board 27. The gasket 31 of the sealing flange 9 is made to engage the back surface of solid siding while the lower edge 33 is sized and configured to allow the gasket 31 to compress against it. The gasket 31 has a first end 32 attached to the top flange section 5 and a second end 34 attached to the lower edge 33. In addition, the lower edge 33 is sized and configured to allow the edge of sheet siding to secure to. The lower edge 33 also has a U-shape that prevents water from entering between the siding and the sealing flange 9. This embodiment is otherwise similar to the embodiment shown in FIG. 2 with similar structure identified by the same reference numbers.

Figure 11:
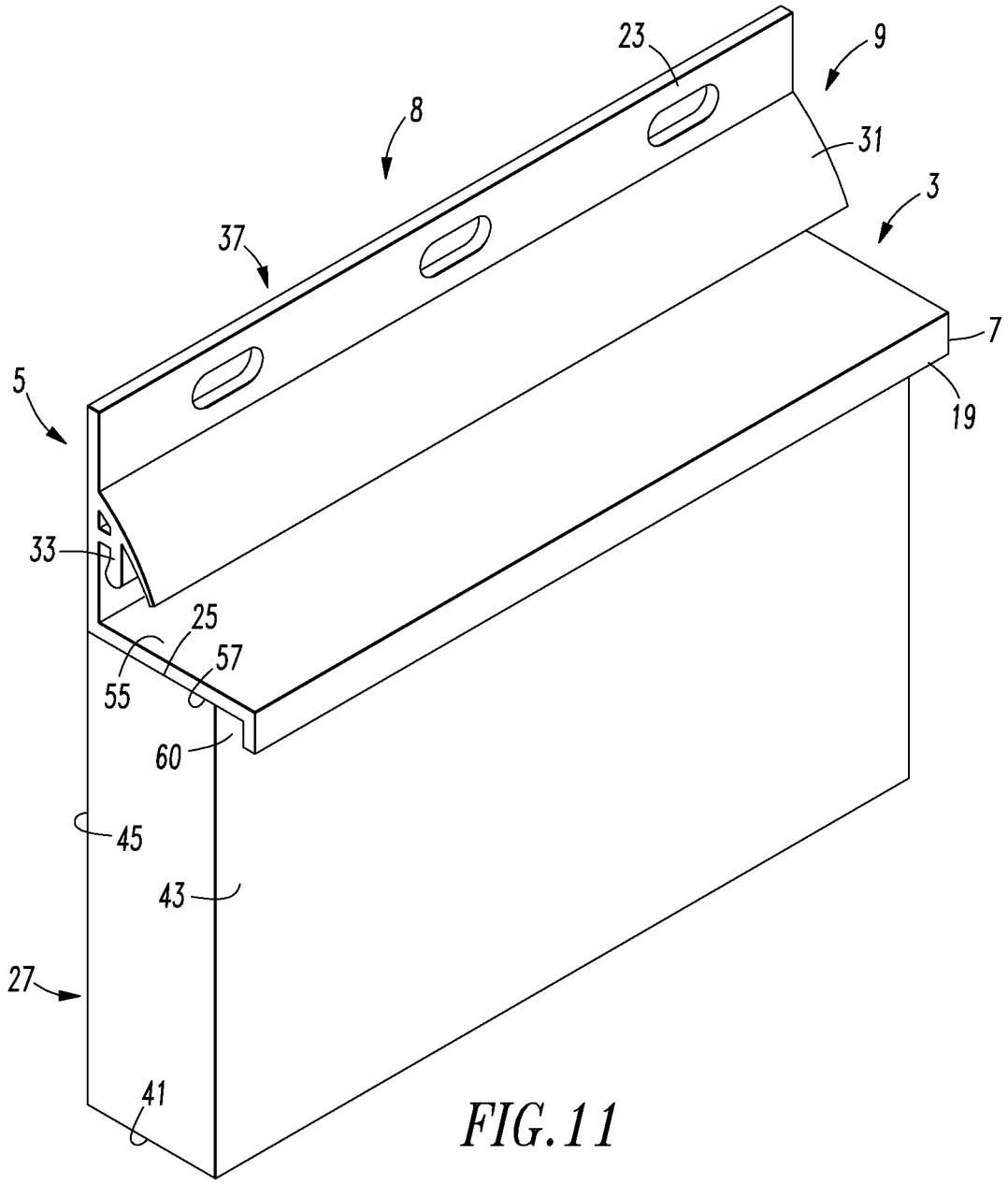
FIG. 11 is a front perspective view of another preferred embodiment of our universal skirt board.

FIG. 11 shows another preferred embodiment of the universal skirt board 8 that comprises a base board 27 and a universal skirt 37. The base board 27 has a top 25, a bottom 41, a front 43, and a back 45. The universal skirt 37 comprises a base 3, a top flange section 5, an overhang section 7, and a sealing flange 9 is attached to the top flange section 5. The base 3 has a top 55 and a bottom 57. The top flange section 5 is attached to the base 3 and the overhang section 7 is attached to the base 3 and defines a drip edge 19. The overhang section 7 extends beyond the base 3 defining a gap 60 between the drip edge 19 and the base board 27. The bottom 57 of the base 3 is attached to the top 25 of the base board 27. The base board 27 and the universal skirt 37 are formed such that the base board 27 and the universal skirt 37 can be integrally connected.

Figure 12:
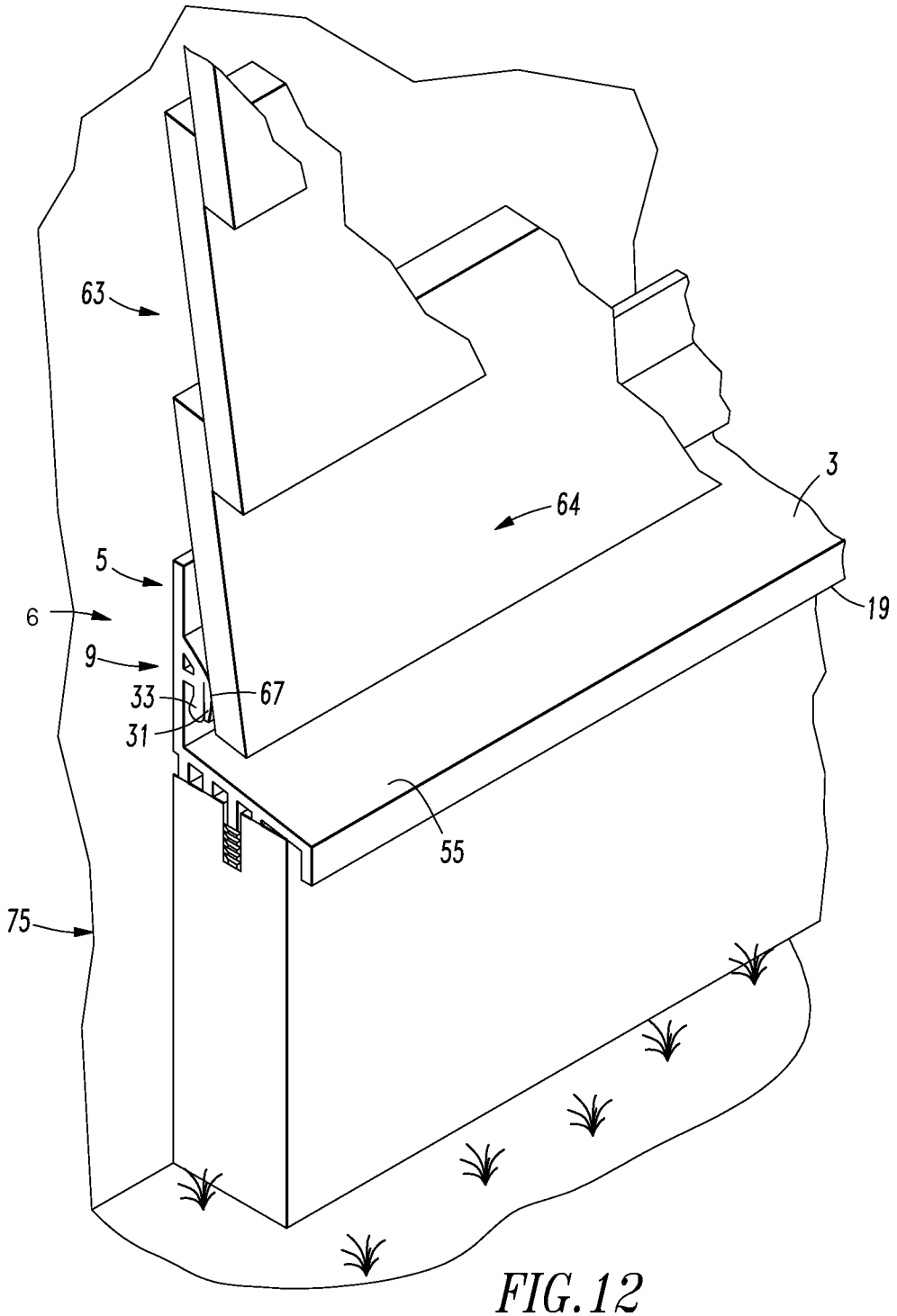
FIG. 12 is a front perspective view of the embodiment shown in FIG. 2 located adjacent to the foundation of a building and used in conjunction with solid siding.

FIG. 12 shows the universal skirt board 8 of FIG. 2 used in conjunction with solid siding 63. The universal skirt board 8 is located adjacent to a foundation 75 of a building and is used in conjunction with solid siding 63. The top flange section 5 of the universal skirt board 8 is fastened to the building near the foundation 75. The gasket 31 of the sealing flange 9 forms a tight seal 67 when the gasket 31 is compressed against the lower edge 33 of the sealing flange 9 by the solid siding 63. Water may run down the front surface 64 of the solid siding 63 and onto the top 55 of the base 3 of the universal skirt board 8. Water may then fall off at the drip edge 19 of the universal skirt board 8 which prevents water from entering near the foundation 75 of the building. Additionally, water is prevented from entering the seam between the universal skirt board and the solid siding by the seal 67 provided by the gasket 31 and the U-shape of the lower edge 33.

Figure 13:
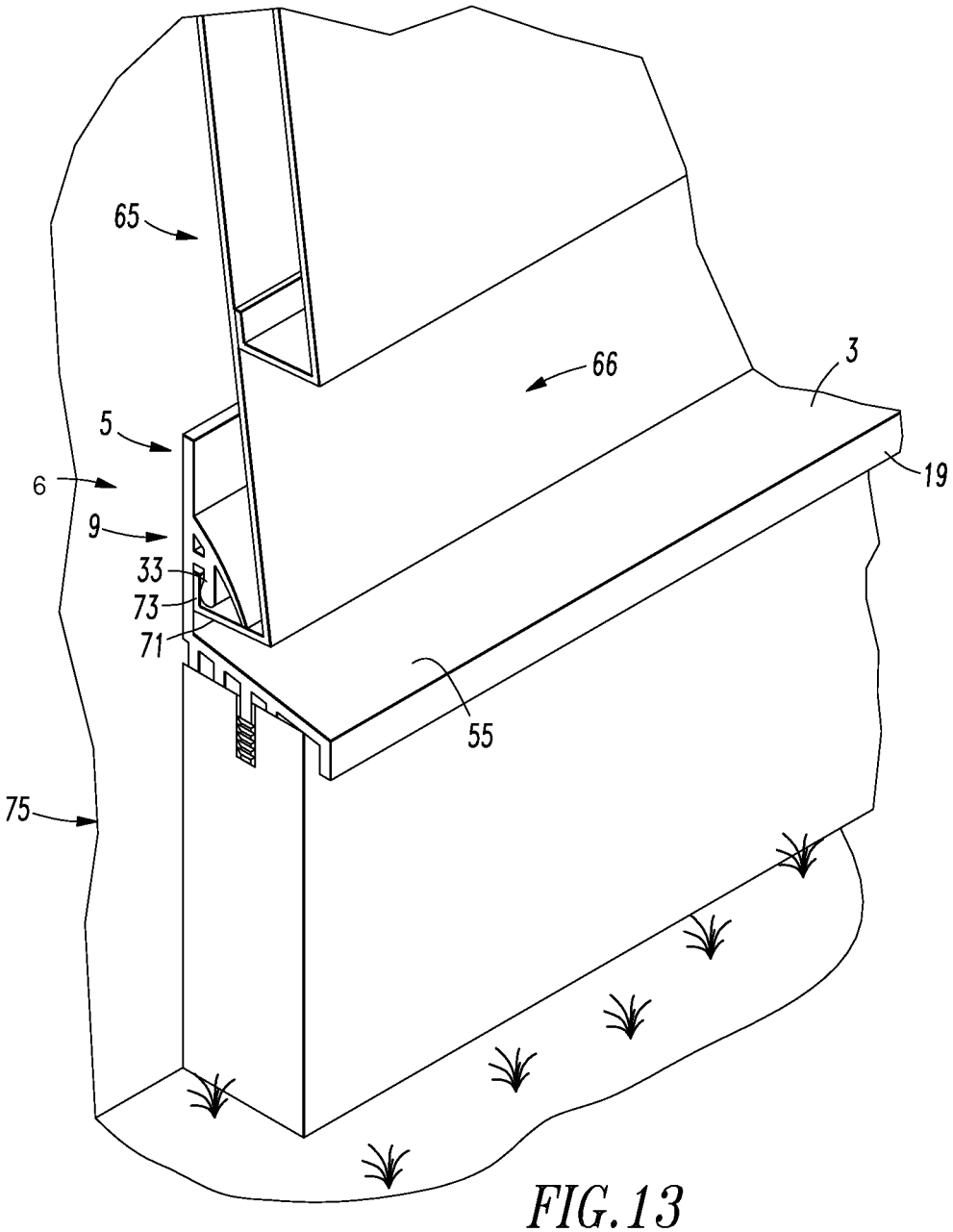
FIG. 13 is a front perspective view of the embodiment shown in FIG. 2 located adjacent to the foundation of a building and used in conjunction with sheet siding.

Similar to FIG. 12, FIG. 13 shows the universal skirt board 8 located adjacent to the foundation 75 of a building and used in conjunction with sheet siding 65. The top flange section 5 of the universal skirt board 8 is fastened to the building near the foundation 75. The edge 73 of sheet siding 65 is locked in place with relation to the universal skirt board 8 by the connecting structure 71 of the lower edge 33 of the sealing flange 9. Water may run down the front surface 66 of the sheet siding 63 and onto the top 55 of the base 3 of the universal skirt board 8. Water may then fall off at the drip edge 19 of the universal skirt board 8 which prevents water from entering near the foundation 75 of the building. Additionally, water is prevented from entering the seam between the universal skirt board 8 and the sheet siding by the connection of the sheet siding 65 and the lower edge 33 and the U-shape of the lower edge 33.

The structure of the universal skirt board allows it to be installed with ease and with many different types of siding, including wood siding, aluminum siding, vinyl siding, hardboard composite, fiberglass, and cement fiber siding. The universal skirt board does not require the use of complex tools in the installation of the universal skirt board or as siding is mated to it. It also reduces the amount of time and number of steps compared to standard methods for constructing similar structures.

Further, the structure of the universal skirt board allows for individuals without a high degree of skill in construction to install the universal skirt board. A novice would intuitively know to place the projection of the universal skirt board in a slot in a board based on the shape of the projection and the shape of the slot. Further, a novice would be able to fit the projection of the universal skirt board into the slot of a base board since this is not a complex connection and does not require complex tools.

While we have shown and described certain present preferred embodiments of our water barrier trim and have illustrated certain present preferred methods of making and using the same, it is to be distinctly understood that the invention is not limited thereto but may be otherwise variously embodied and practiced within the scope of the following claims.

We claim:

1. A universal skirt board comprising:

a base having at least one ridge extending away from the base in a first direction, and a projection extending in the first direction;

a top flange having a first end attached to the base and a second end opposite the first end, the top flange having a first side and a second side, the first side configured to come into contact with a surface upon which the top flange is to be attached and the second side is opposite the first side;

an overhang section adjacent to the base defining a drip edge;

a sealing gasket attached to the second side of the top flange and extending over at least a portion of the second side of the top flange; and wherein the sealing gasket is made from soft vinyl and the top flange is made from rigid vinyl relative to the soft vinyl;

wherein the at least one ridge is formed to rest on a top of a base board; and wherein the base, the top flange, the overhang section, and the sealing gasket are formed such that the base, the top flange, the overhang section, and the sealing gasket are integrally connected.

2. The universal skirt board of claim 1, wherein the projection has at least one protrusion, the at least one protrusion of the projection is sized and configured to engage a slot of a trim board.

3. The universal skirt board of claim 1, wherein the universal skirt board is a plastic extrusion.

4. The universal skirt board of claim 1, wherein the top flange has a structure to allow the top flange to be fastened to a surface, wherein the structure is plurality of apertures or an adhesive.

5. The universal skirt board of claim 4, wherein the top flange section has peel and stick tape attached to seal the top flange section to a surface.

6. The universal skirt board of claim 1, wherein the sealing gasket comprises a U-shape portion that is sized and configured to engage an edge of a sheet of material.

7. The universal skirt board of claim 1, further comprising a base board having a top, a bottom, a front, and a back, the top having a middle and a slot defined in the middle, wherein the at least one ridge rests on the top of the base board and the projection is located in the slot in the top of the base board providing an interference connection.

8. A universal skirt board assembly comprising a base board and a universal skirt wherein:

the base board having a top, a bottom, a front, and a back, the top having a top surface; and the universal skirt comprising:

a base having a top and a bottom, the bottom having a bottom surface;

a top flange section having a first end attached to the base and a second end opposite the first end;

an overhang section attached to the base defining a drip edge; and a sealing gasket attached to the second end of the top flange section;

wherein the sealing gasket is made from soft vinyl and the top flange is made from rigid vinyl relative to the soft vinyl;

wherein the base, the top flange section, the overhang section, and the sealing gasket are formed such that the base, the top flange, the overhang section, and the sealing gasket are integrally connected; and wherein the bottom surface of the bottom of the base is attached to the top surface of the top of the base board.

9. The universal skirt board assembly of claim 8, wherein the base board and the universal skirt are integrally connected.

10. The universal skirt board assembly of claim 8, wherein the top flange section has a structure to allow the top flange section to be fastened to a surface, wherein the structure is plurality of apertures or an adhesive.

11. The universal skirt board assembly of claim 10, wherein the top flange section has peel and stick tape attached to seal the top flange section to a surface.

12. The universal skirt board of claim 8, wherein the sealing gasket comprises a U-shape portion that is sized and configured to engage an edge of a sheet of material.

* * * * *